United States Patent [19]

Bogner

[11] 4,301,457

[45] Nov. 17, 1981

[54] ANTENNA EMPLOYING CURVED PARASITIC END-FIRE DIRECTORS

[76] Inventor: Richard D. Bogner, 4 Hunters La., Roslyn, N.Y. 11576

[21] Appl. No.: 938,884

[22] Filed: Sep. 1, 1978

[51] Int. Cl.[3] ..... H01Q 15/16

[52] U.S. Cl. ..... 343/770; 343/833; 343/836; 343/891

[58] Field of Search ..... 343/809, 770, 833, 834, 343/835, 836, 891

[56] References Cited

U.S. PATENT DOCUMENTS

| | | | |
|---|---|---|---|
| 3,478,363 | 11/1969 | Wells | 343/809 |
| 3,821,745 | 6/1974 | Bogner | 343/891 |
| 3,975,733 | 8/1976 | Bogner | 343/891 |

*Primary Examiner*—Eli Lieberman

*Attorney, Agent, or Firm*—Leonard H. King

[57] ABSTRACT

An antenna assembly comprising elementary driven antenna elements and curvilinear end-fire directors on a conventional supporting structure to obtain an omnidirectional or other desired antenna pattern, even for supporting structures of relatively large transverse dimensions. The end-fire directors employ one or more curved conductive members.

11 Claims, 2 Drawing Figures

ANTENNA EMPLOYING CURVED PARASITIC END-FIRE DIRECTORS

BRIEF SUMMARY OF THE INVENTION

The present invention relates to antennas employing end-fire parasitic elements, and more particularly to such antennas for television broadcasting.

In the design of transmitting antennas for television broadcasting, and especially for UHF-TV frequencies (e.g. 470 mHz. to 890 mHz.), it is generally desired to achieve high gain with an omnidirectional pattern (or a pattern of some other desired shape) in the azimuth plane at minimum cost. For omnidirectional performance, the total or maximum signal strength variation as a function of azimuth plane direction cannot be more than approximately 3 db ($\pm 1.5$ db) in accordance with trade acceptance and FCC standards, and such an antenna pattern is very often required by a broadcasting station providing service to a given region or community.

To achieve a high overall antenna gain, it is the usual practice to vertically stack a large number of driven antenna elements, each one defining a "bay", to typically provide a vertical array extending for 20 to 50 feet, or more. In view of the substantial vertical height thus needed, the supporting structure, typically a metal tower or mast pole, on which the elementary driven antenna elements are supported, will generally be made with a relatively large diameter. That is, the supporting structure will generally have a major transverse dimension greater than one-quarter wavelength, at the transmitted frequency, to provide the strength and rigidity necessary to mechanically support the antenna assembly and maintain stability in the wind and weather conditions to which it may be subjected. However, a relatively large diameter supporting structure, (e.g., of about a quarter wavelength or greater) generally produces a so-called "shadowing" effect on the resulting antenna pattern, and due to this effect a simple, single vertical array of driven antenna elements on such a supporting structure will not ordinarily provide the omnidirectional, or other desired shaped pattern required for a particular broadcasting application.

In U.S. Pat. Nos. 3,587,108 and 3,821,745, of the present inventor, there is disclosed and claimed an antenna assembly structure for achieving an omnidirectional or other desired pattern with a single vertical linear array of elementary antennas mounted on a large diameter structure of any conventional construction, wherein the assembly generally comprises the supporting structure, a driven antenna carried by the supporting structure and defining a radiation axis extending therefrom, and at least one end-fire parasitic director carried by the supporting structure. The end-fire parasitic director, in accordance with the preferred embodiments of those patents, has a longitudinal axis and comprises discrete planar, conductive plates disposed in spaced parallel relation along that axis and arranged normal thereto or with a planar portion bent at a substantial angle thereto. The discrete conductive plates have their respective major dimensions at least a quarter-wavelength in the plane of the electric field vector of the transmitted signal, and each director is positioned relative to the driven antenna and supporting structure so as to alter the shape of the antenna pattern produced by their combined effects to provide the selected overall antenna pattern for the assembly. One or more of such parasitic directors may be employed, as desired in combination with the supporting structure and driven elements to produce any number of pattern shapes, from omnidirectional to highly directional, and these are described in detail in the aforementioned patents, the subject matter of which is hereby incorporated into the instant application by reference thereto.

Because of the high gain, and consequent great height, requirements of such antenna assemblies, it is often necessary, as previously indicated, to make the transverse dimension of the support structure, such as the diameter of a supporting mast or pipe, or the equivalent dimension of triangular or other shaped towers, not only greater than a quarter-wavelength, but at least one-half wavelength or more. And, in particular, it should be noted here that although omnidirectional performance is the most common requirement for broadcast antenna designs, it is generally the most difficult criterion to meet. Antennas requiring directive performance are almost always easier to design. Thus, omnidirectional performance is typically the governing design criterion, and because of shadowing effects, the principal controlling parameter is the support mast size (in wavelengths).

In practice, conventional steel pipe is commonly employed for the supporting mast since it is relatively inexpensive and can be flanged, whereas "high strength" steels cannot. Consequently, from practical design considerations, such mast pipes for UHF broadcasting, for example, are commonly required to have diameters of from one-half to three-quarters wavelength, based on existing transmitter tube powers, FCC rules on effective radiated power (ERP), yield strengths of the steel, considerations regarding the power handling characteristics of the coaxial feed lines located inside the pipe, etc.

Although with mast structures of less than one-half wavelength diameter, it may be practical in many antenna designs according to the teachings of the aforementioned patents to use only two plates per end-fire director to achieve an omnidirectional pattern, for mast structures having diameters larger than one-half wavelength a greater number of plates per director is generally required to maintain the same omnidirectional performance. However, it has been found that as the mast diameter is increased, which generally increases the required number of plates per director, undesirably sharp lobes and nulls tend to be formed in the antenna pattern. This increases the criticality of the director positions, and in some cases, requiring the use of additional endfire directors for pattern smoothing. In certain cases the 3 db omnidirectional pattern may not be possible to attain at all with only two end-fire directors per bay, regardless of the number of plates employed. The employment of large numbers of plates per director and the potential need for more than two directors per bay considerably worsen the problems of supporting the directors and the problems associated with wind load, in addition to increasing the cost of the antenna assembly. Also, the frequency band over which acceptable performance is obtained is reduced, often below one channel width.

Accordingly, it is an object of the present invention to provide an improved antenna assembly which may employ a low cost, conventional supporting structure, and which obviates or minimizes the aforementioned problems while maintaining a high gain, omnidirectional or other desired antenna pattern, even for supporting structures having extremely large transverse dimensions.

The present invention stems from the discovery that considerable further size reduction and bandwidth increase can be obtained through the use of one or more end-fire parasitic directors when one or more of the plates are bent to a curved surface and have at least a predetermined transverse height.

Moreover, it has been found that for a given diameter (or equivalent dimension) supporting structure, fewer plates on the end-fire directors are required to achieve omnidirectional performance when one or more of the plates of each director are curved in the aforementioned manner. For example, for masts even greater than one-half wavelength in diameter, one curved plate will often be sufficient instead of the two spaced bent or flat plates heretofore generally required to provide the omnidirectional pattern. Up to approximately three-quarter wavelength mast diameter, two plates per director will typically produce the omnidirectional pattern with one or both curved as needed, as compared to the requirement of four or more flat plates or two or more bent per director, with the attendant problems previously mentioned.

The curve radius should be between one-quarter and twice that of the support structure if round, or between one-eighth and one time the major transverse dimension of the support structure if other than round.

These and other objects and advantages of the present invention are more particularly set forth in the following detailed description and in the accompanying drawings.

DETAILED DESCRIPTION

Figure 1:
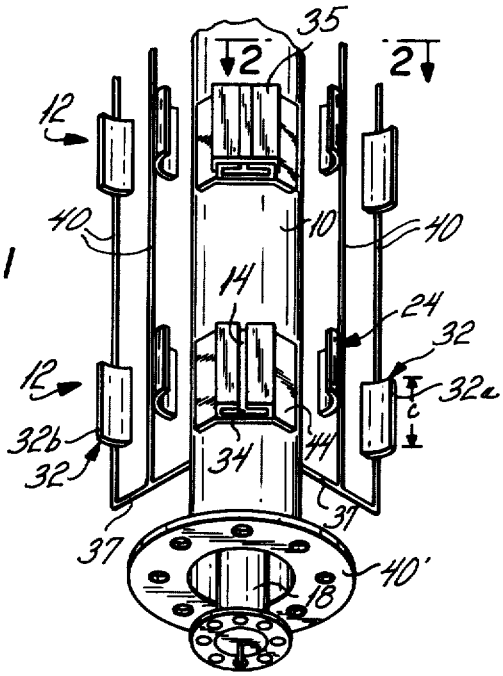
FIG. 1 is a perspective view showing a portion of a section of an antenna assembly in accordance with an embodiment of the present invention.
Figure 2:
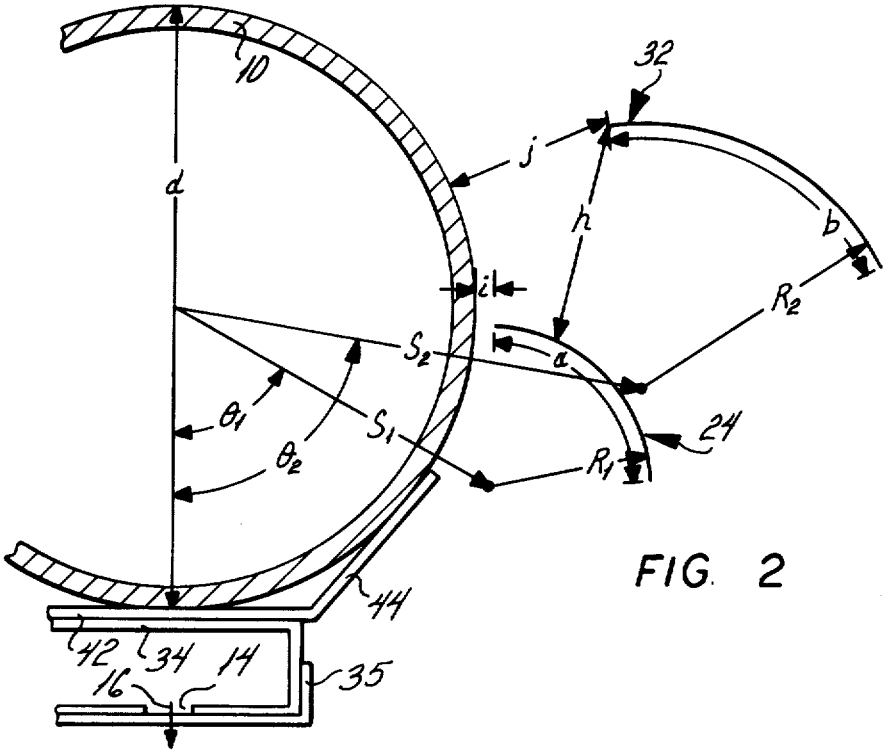
FIG. 2 is a schematic showing of the plate relationship to the radiating cavity taken along line 2—2 of FIG. 1.

In general, referring to FIGS. 1 and 2, the antenna assembly in accordance with this embodiment of the invention is especially adapted for transmitting UHF-TV signals of a given wavelength fed thereto from a suitable broadcast transmitter. The assembly generally comprises an elongated conductive supporting structure, illustrated as a vertical tubular mast or pipe section 10, having a major transverse dimension d such as to affect the overall pattern of the antenna assembly, and a plurality of bays, each indicated generally as 12, which include a driven antenna element 14 carried by the mast 10 and defining a radiation axis 16 extending therefrom. The radiation axis of each driven antenna element is considered herein to be the axis of symmetry of the beam radiated from that element in the direction away from the radiating side of the element and is usually the direction of maximum radiation. A transmission line, illustrated as coaxial cable 18, is provided for feeding the electrical signals to the driven antenna elements in each of the bays vertically stacked along the mast. At least one but in most instances two end-fire parasitic directors, such as 32*a* and 32*b*, are associated with the driven antenna element of a bay.

The end-fire directors are so positioned relative to the driven antenna and supporting structure as to alter the shape of the antenna pattern produced by the combined effects of the driven antenna and supporting structure to obtain an omnidirectional or other desired pattern, while not intersecting the radiation axis 16 of the driven antenna.

The end-fire director shown in FIG. 2 is representative of all the directors of FIG. 1, and will be referred to hereinafter for purposes of discussion. Each end-fire director comprises one or more curved conductive members 24. As shown in the illustrated embodiment of FIGS. 1 and 2, two plates are employed with each end-fire director, the inner or closer plate 24 (relative to the driven element 14) is curved, and the outer or further plate 32 is curved. Of course, depending on the diameter d (in wavelengths) of the mast 10 and the desired antenna pattern shape, the further plate 32 might be flat, or it might be omitted, or additional such plates might be employed.

Each of the conductive plates 24 and 32 has a major linear dimension a and b, respectively, in a plane parallel to the plane of the electric field or E vector, being the horizontal dimension in the present embodiment, of between one-quarter and one-half wavelength, regardless of the curve, and preferably about one-third wavelength. The major orthogonal dimension c, which is the vertical dimension of both plates in the present embodiment, may be of any value, but is often at least approximately one-third wavelength or greater. The performance or effectiveness of the director in achieving an omnidirectional pattern for the assembly increases as this vertical dimension or height of the conductive plates approaches the length of the slot (or the equivalent dimension of some other type of driven antenna element). Beyond this length, there is no significant increase in effectiveness with respect to the driven element of the associated bay. The length of the slot may generally be from about one-half to just under one wavelength, with two-thirds wavelength being typical.

A suitable interplate spacing range, such as indicated as h and defined hereinafter, is generally between approximately one-eighth and one-half wavelength, with one-fourth wavelength being preferred.

Turning now more specifically to the particular structures, illustrated in FIGS. 1 and 2, the tubular mast 10 provides support for the antenna assembly, and may be typically formed from standard pipe of hot-dip galvanized structural steel to retard corrosion and to provide strength at low cost. The individual slot type driven antenna elements 14 of the illustrated assembly are (as shown open in the lower bay of FIG. 1) cut into, or mounted on, the mast 10. Behind each of the slots is a cavity 34 of the type commonly employed in radiating antennas to form an impedance-match the slots, and the cavities may be merely formed as sheet metal structures. A dielectric cover 35 may be placed over each of the slots as a radome, and may be formed, for example, of glass fibercloth impregnated with a synthetic resin. Each slot of the antenna array is fed a portion of the transmitter power through the transmission line 18 located within the tubular mast 10 and connected in a known manner to the slots for excitation thereof.

Mounted onto the tubular mast, on either side of each slot antenna are mounting brackets 37 which support the end-fire parasitic plates 24 and 32 in conjunction with members 40. These members may be of conductive or non-conductive materials (with slot type driven elements).

At the bottom of the tubular mast 10 is a flange 40 which may be fastened to another such flange to interconnect two adjacent mast sections for extendng the length of the antenna assembly, or which may be fastened to a tower or other base structure, such as by means of suitable bolts or other fasteners through the flange holes shown in FIG. 1. Suitable coaxial connectors of conventional type may also be provided for interconnecting the various sections of transmission line 18, as required, and in a well known manner.

In the type of antenna assembly contemplated herein, there is no connection except a structural one, between the elementary driven antennas which transmit electromagnetic radiation and the end-fire directors. That is, the end-fire directors act on the radiating electromagnetic field, but are not necessarily conductively connected to the driven antenna elements. Moreover, it is not, in general, necessary for the directors to be located directly adjacent to the center of their associated elementary antennas in each bay of the antenna assembly. Also, if desired, more than one level or set of end-fire directors may be associated with each elementary antenna, and various arrangements may be employed based on the general teachings hereof to obtain particular desired pattern shapes. By varying the particular angle (relative to the radiation axis of the associated driven antenna element), location, and design of the directors, the horizontal or azimuth plane of radiation can be readily controlled to provide the desired antenna pattern.

The following particular antenna assembly constructions in accordance with the embodiment of the invention illustrated in FIGS. 1 and 2 have been designed and performed satisfactory for channel 45 to provide the ±1.5 db omnidirectional specification. The assemblies designed for each of these channels utilized one pair of end-fire directors per bay on each side of the mast and two plates per director. All of the plates were 12 inches in height (c=12, but could have been made as small as 6 inches in height). The other dimensions common to these assemblies were that the diameter d of the mast 10 was 10¾ inches (O.D), the width of the cavity mounting plate 42 was 5½ inches. All of the plates were formed from ⅛ inch thick stock of open mesh design with 1 inch maximum opening to reduce wind loading.

Typical dimensions for a broadband design are as follows:

(h is minimum dimension between plates, measured in a plane normal to pipe axis.)

Ch. 43 to 47

$a=5\frac{1}{2}''$
$b=6''$
$c=12''$
$d=10\frac{3}{4}''$
$h=4''$
$r_1=3''$
$r_2=5''$
$s_1=6\frac{1}{2}''$
$s_2=8\frac{1}{2}''$
$\theta_1=60°$
$\theta_2=80°$
$i=\frac{1}{4}''$
$j=3\frac{1}{4}''$ The use of conductive plate elements having various surface portions removed is possible because these elements still function as a solid plate with respect to their interaction with the electromagnetic waves being radiated from the antenna. Thus, the term "plate" is used herein in an electrical or electromagnetic wave sense and includes various mechanical structures that affect the wave length in the general manner of a plate, but which may actually have the mechanical or physical form of only portions of a solid plate, a mesh or screen, wires or rods or other conductive elements. Also, such plate structures need not be rectangular, but may be of other shapes, such as disks, etc., as long as they are dimensioned and positioned to achieve the desired results. The plates may also extend continuously, if desired, from each bay to the next, rather than being discrete with respect to each vertically spaced director. Also, use of a number of short flat segments which approximate a smooth curve may, in some cases, be more practical to achieve, but will function essentially as a smooth curve.

Although the illustrated antenna assembly, the driven antenna element which is used as a launcher is a slot, it is understood that any driven type of element could be used, including (but not limited to) a dipole, Vee, loop or short helix. Also, it is understood that although the plate elements in the illustrated embodiment are supported on metallic support rods, other means, including insulators, for supporting the conductive plates may be employed.

The final design of an antenna assembly for any particular application in accordance with the principles of the present invention is determined readily by routine design techniques and simple experiment, applying the teachings hereof.

Also, the teachings of U.S. Pat. Nos. 3,718,934 and 4,021,815 of the same inventor, are applicable to the antenna assembly of the present invention to provide interlaced antenna arrays on a common supporting structure which perform almost independently with very little coupling or interaction despite their proximity, and to provide circularly polarized antennas.

The embodiments of the invention illustrated in the drawings and described above will suggest to persons skilled in the art a number of variations and modifications, some being immediately obvious and others obvious upon study from the basic teachings of the invention. Although such variations and modifications may result in structures which are mechanically different in appearance, they may embody the principles of the invention. Therefore, the scope of the protection to be afforded the invention should not be limited by the particular embodiments shown and described, but should be defined by the appended claims and equivalents thereof.

Various features of the invention are set forth in the following claims.

What is claimed is:

1. An antenna assembly for transmitting signals of a given wavelength, comprising an elongated electrically conductive supporting structure having a major transverse dimension such as to effect the pattern of the antenna assembly, a driven antenna element carried by said supporting structure and defining a radiation axis extending therefrom, and at least one end-fire parasitic director extending generally from said structure and comprising a conductive member concavely curved with respect to said structure in a plane containing the electric vector radiated by the said driven antenna element, which plane is also normal to the axis of said elongated conductive supporting structure, said director being so positioned relative to said driven antenna and supporting structure as to alter the shape of the antenna pattern produced by the combined effects of said driven antenna and supporting structure, while not intersecting the radiation axis of said driven element, to provide a selected pattern for said antenna assembly said conductive member being curved with an average radius between one-eighth and one times the major transverse dimension of the support structure and has a linear dimension in said plane between approximately one-fourth and one-half wavelength.

2. The antenna assembly of claim 1 wherein said linear dimension is approximately one-third wavelength.

3. The antenna assembly of claim 1, wherein said end-fire director includes another similar conductive member also concavely curved with respect to said structure spaced with a minimum separation from said first mentioned conductive member a distance approximately from one-eight to one-half wavelength, as measured in the said plane in which the conductors are curved.

4. The antenna assembly of claim 3 wherein said distance is approximately one-fourth wavelength.

5. The antenna assembly of claim 1 further comprising another end-fire director like said first mentioned end-fire director, wherein each of said directors is mounted to said elongated supporting structure on opposite sides of said driven element.

6. An antenna assembly for transmitting signals of a given wavelength, comprising a vertical elongated electrically conductive supporting structure having a transverse dimension of at least approximately one-fourth wavelength, at least one bay including a driven antenna element carried by said structure for producing radiation of horizontal polarization and defining a radiation axis extending from said element, means for feeding electrical energy signals to said driven antenna element, and a pair of end-fire parasitic directors extending generally horizontally from said driven element, each of said directors comprising a conductive member having a linear dimension in a plane parallel to the plane of the electric field vector to the transmitted signal of approximately one-fourth to one-half wavelength, said conductive member concavely curved with respect to said structure in the horizontal plane, said conductive member having a vertical dimension of at least approximately one-third wavelength, said director being so positioned relative to said driven antenna and supporting structure so as to alter the shape of the antenna pattern produced by the combined effects of said driven antenna and supporting structure, while not intersecting said radiation axis, to provide a selected pattern for said antenna assembly, wherein said end-fire directors each include additional conductive members concavely curved with respect to said structure, wherein the minimum spacing between the said conductive members measured in the horizontal plane is approximately one-eighth to one-half wavelength.

7. The antenna assembly of claim 3, wherein the radius of curvature of said first conductive member is less than the radius of curvature of said second conductive member.

8. The antenna assembly of claim 3, wherein the separation between the ends of said first and second conductive members is less at the ends adjacent to said structure than at the ends farthest away from said structure.

9. An antenna assembly as in claim 3, wherein the center of curvature of said first conductive member lies along a line having a first angular relationship with respect to said radiation axis, the center of curvature of said second conductive member lies along a line having a second angular relationship with respect to said radiation axis, and wherein said second angular relationship is greater than said first angular relationship.

10. An antenna assembly as in claim 9, wherein said second center of curvature lies radially farther outward from the axis of said structure than said first center of curvature.

11. The antenna assembly of claim 6, wherein the radius of curvature of the conductive member closer to said structure is less than the radius of curvature of the other conductive member.

* * * * *